US008090300B2

(12) United States Patent
Suenami

(10) Patent No.: US 8,090,300 B2
(45) Date of Patent: Jan. 3, 2012

(54) POWDER CONVEYING APPARATUS

(75) Inventor: Koji Suenami, Osaka (JP)

(73) Assignee: Kyocera Mita Corporation (JP)

( * ) Notice: Subject to any disclaimer, the term of this patent is extended or adjusted under 35 U.S.C. 154(b) by 724 days.

(21) Appl. No.: 11/881,463

(22) Filed: Jul. 27, 2007

(65) Prior Publication Data

US 2008/0025763 A1 Jan. 31, 2008

(30) Foreign Application Priority Data

Jul. 31, 2006 (JP) ..... 2006-208082

(51) Int. Cl.
*G03G 15/08* (2006.01)

(52) U.S. Cl. ..... 399/254; 399/256

(58) Field of Classification Search ..... 399/254, 399/256, 263
See application file for complete search history.

(56) References Cited

U.S. PATENT DOCUMENTS 4,739,907 A * 4/1988 Gallant ..... 222/240
5,005,517 A 4/1991 Fukui et al.
5,758,238 A * 5/1998 Mordenga et al. ..... 399/256
2002/0009309 A1* 1/2002 Suzuki ..... 399/254
2003/0175050 A1 9/2003 Murayama et al.
2005/0123321 A1* 6/2005 Buhay-Kettelkamp et al. ..... 399/254
2005/0238389 A1* 10/2005 Kim et al. ..... 399/238

FOREIGN PATENT DOCUMENTS

JP 2-18584 1/1990
JP 2003-270947 9/2003

* cited by examiner

*Primary Examiner* — David Gray
*Assistant Examiner* — Roy Y Yi
(74) *Attorney, Agent, or Firm* — Gerald E. Hespos; Michael J. Porco

(57) ABSTRACT

A powder conveying apparatus, comprising a powder container for storing powder and a powder agitating/conveying member provided in the powder container, wherein the powder agitating/conveying member includes: a shaft revolving around the axis; a primary conveying blade provided on the external surface of the shaft in such a manner that the powder is conveyed in the first direction toward one side of the axial direction, by revolution in one rotational direction around the axis of the shaft; and a secondary conveying element provided on the external surface of the shaft and located radially inner than a radially outer end of the primary conveying blade in the diameter direction in such a manner that conveying force is applied to part of the powder, which is conveyed in the first direction by the primary conveying blade, in the second direction toward the other side of the axial direction.

12 Claims, 8 Drawing Sheets

POWDER CONVEYING APPARATUS

BACKGROUND OF THE INVENTION

1. Field of the Invention

The present invention relates to a powder conveying apparatus conveying while agitating powder such as developer.

2. Description of the Background Art

Image forming apparatuses, such as copying machine, printer and facsimile, forming an image by using developer containing toner particles have a developing device for conveying powder such as developer containing toner while stirring it. Such a developing device has a powder agitating/conveying member conveying while agitating powder. The powder agitating/conveying member has a screw blade connected to a shaft that agitates and conveys the powder by revolution around an axis thereof.

For prevention of toner scattering and image defects such as high background soil by thorough agitation of the powder, known is a configuration having, between screw blades, a rib inclined toward revolution direction from an external surface to a center of the shaft and also inclined toward the direction almost perpendicular to the helical direction of the screw blade from the axial direction of the shaft (see, for example, Japanese Unexamined Patent Publication No. 2003-270947).

However, such a configuration containing a rib causes a problem that the powder conveying speed became lower than that when the rib is absent. In the recent trend toward acceleration of printing, there is a need for higher printing speed. Higher printing speed leads to higher consumption rate of the developer containing toner, which, in turn, demands higher conveying speed of the developer. On the other hand, the increase in conveying speed causes a problem of insufficient agitation of the developer.

SUMMARY OF THE INVENTION

An object of the present invention is to provide a powder conveying apparatus which enables sufficient agitation of powder such as developer without reducing the conveying speed.

A powder conveying apparatus according to an aspect of the present invention, which achieves the object above, comprises: a powder container for storing powder; and a powder agitating/conveying member provided in the powder container. The powder agitating/conveying member includes: a shaft revolving around an axis thereof; a primary conveying blade provided on an external surface of the shaft to thereby convey powder in a first direction along an axial direction by revolution in one rotational direction around the axis of the shaft; and a secondary conveying element provided on the external surface of the shaft and located radially inner than a radially outer end of the primary conveying blade to thereby cause a conveying force to a part of the powder being conveyed in the first direction by the primary conveying blade, the conveying force being in a second direction along the opposite axial direction.

The secondary conveying element may be formed on an external surface of the shaft to thereby cause a conveying force in a first direction to a part of the powder being conveyed by the primary conveying blade at a conveying speed different from that of the primary conveying blade.

Alternatively, a groove serving as the secondary conveying element may be formed in the external surface of the shaft.

DETAILED DESCRIPTION OF THE PREFERRED EMBODIMENTS

A powder conveying apparatus including a powder agitating/conveying member according to an embodiment of the present invention will be described with reference to attached drawings.

First Embodiment

Figure 1:
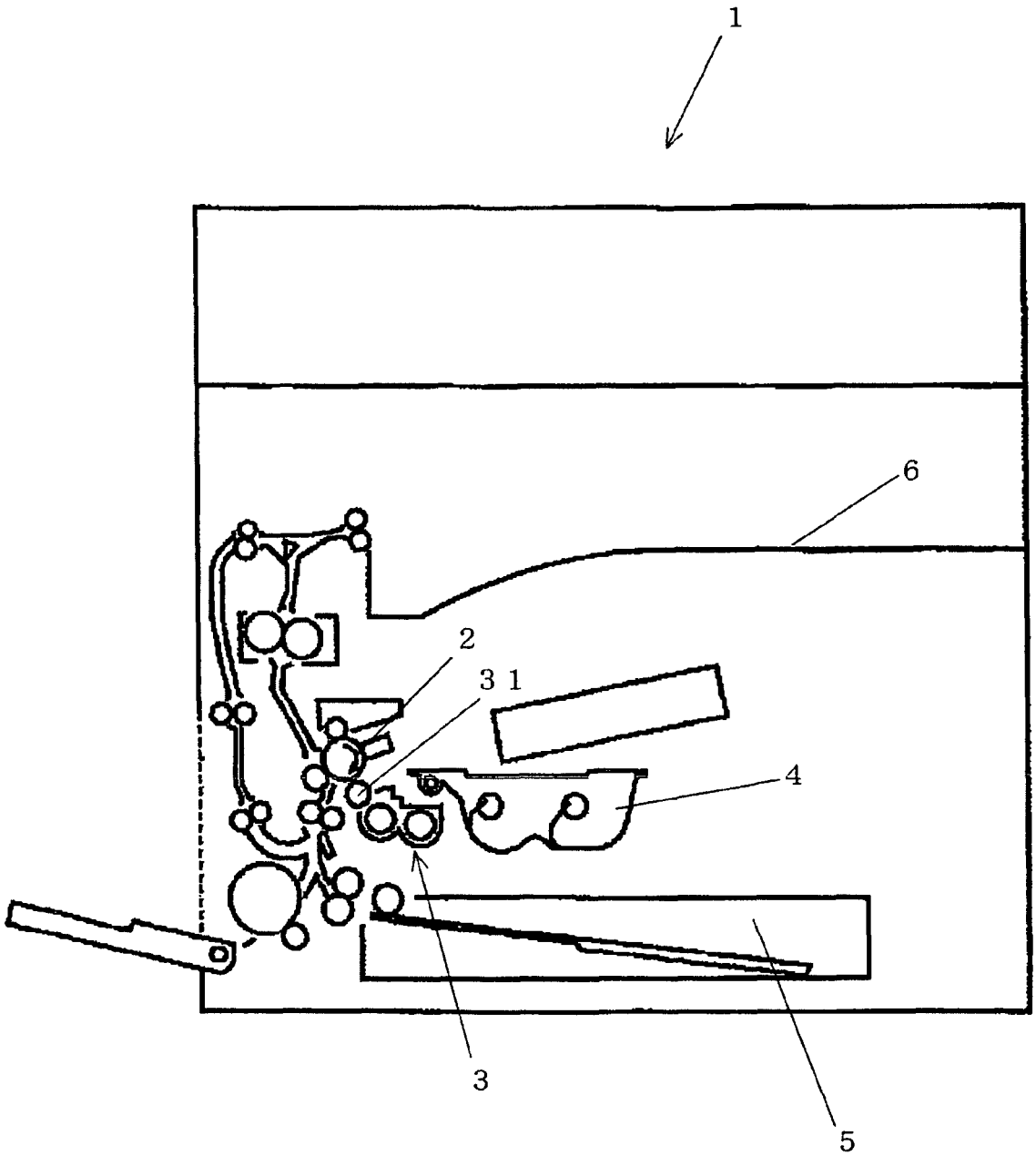
FIG. 1 is a schematic diagram illustrating an image forming apparatus provided with a developing device or powder conveying apparatus including a powder agitating/conveying member according to an embodiment of the present invention.

FIG. 1 is a schematic diagram illustrating an image forming apparatus 1 provided with a developing device or powder conveying apparatus having a powder agitating/conveying member according to an embodiment of the present invention. The image forming apparatus 1 has a photoconductive drum 2 for transferring a print image on a conveyed image bearing medium such as a sheet of paper, a developing device 3 provided with a developing roller 31 for developing a latent image formed on the photoconductive drum 2, a toner cartridge 4 for supplying toner to the developing device 3, a sheet supply tray 5 for supplying transfer sheet, and a sheet discharge tray 6 to which a transfer sheet bearing a print image is discharged. The present invention is applicable widely, for example, to laser printer, facsimile, and copying machine that use a developer such as toner.

Figure 2:
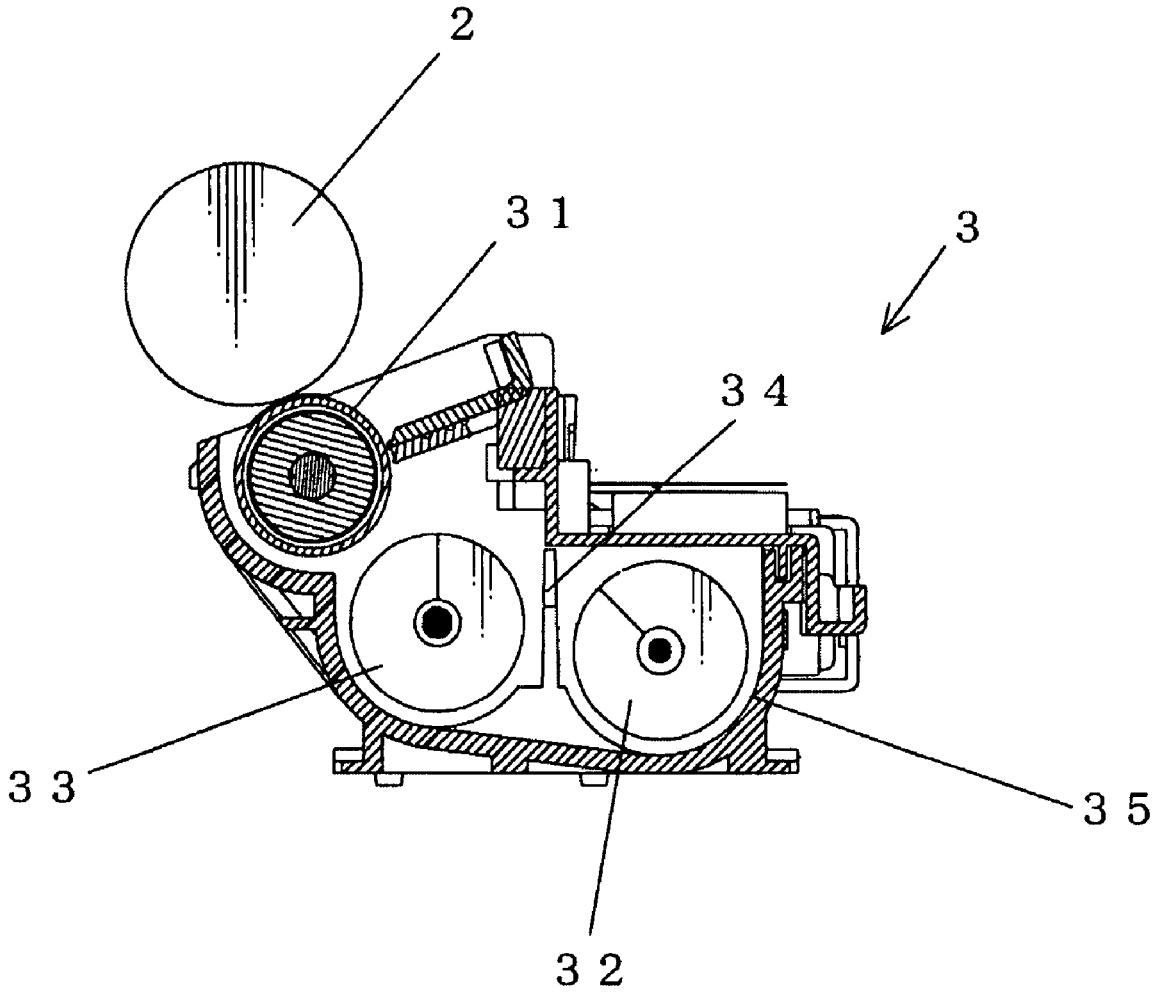
FIG. 2 is a vertical sectional view illustrating the developing device shown in FIG. 1.
Figure 3:
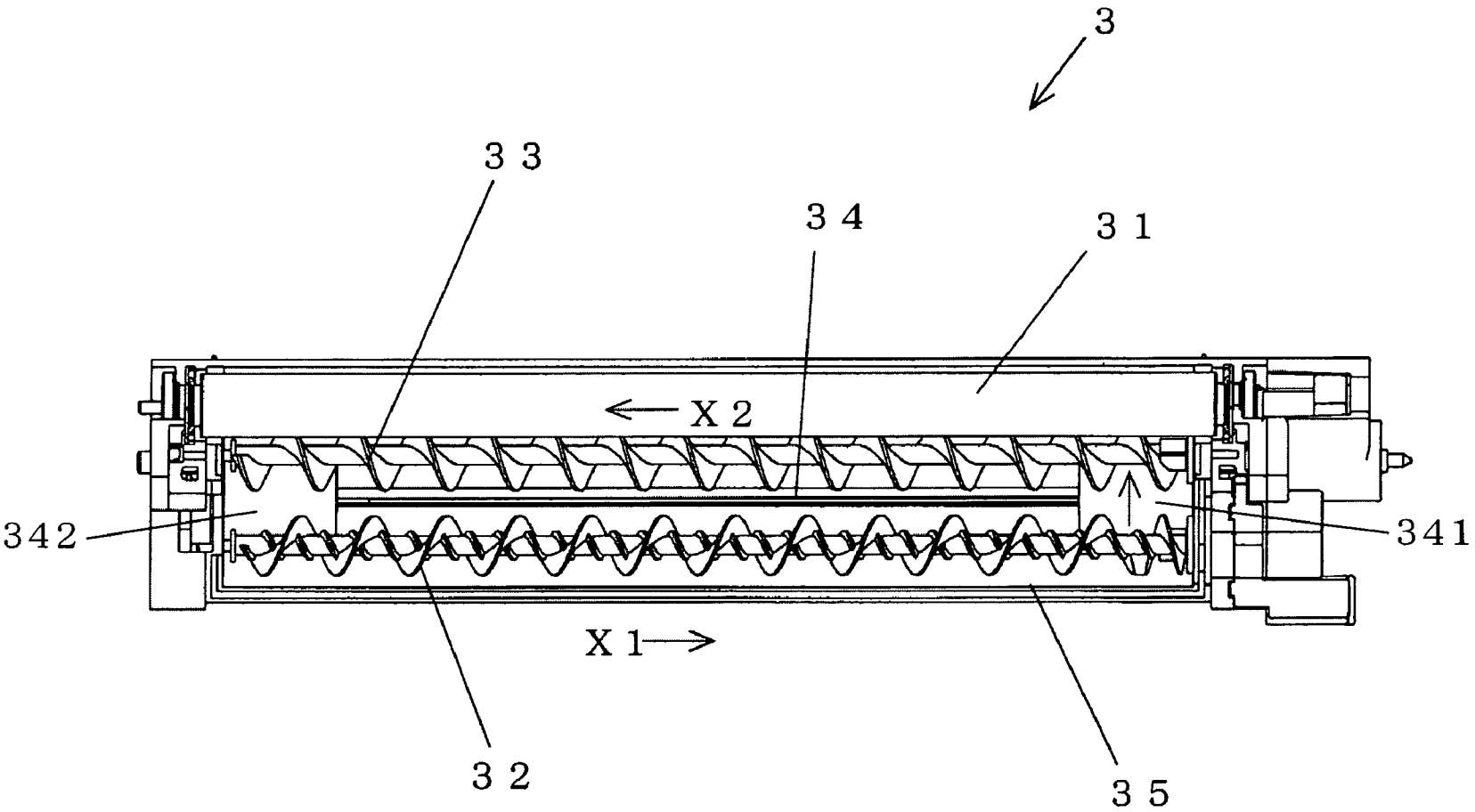
FIG. 3 is a top plan view illustrating the developing device shown in FIG. 1.

FIG. 2 is a sectional view illustrating the developing device shown in FIG. 1. FIG. 3 is a top plan view illustrating the developing device shown in FIG. 1.

In the present embodiment, as shown in FIGS. 2 and 3, the developing device 3 has a powder container 35 for storing toner particles supplied from the toner cartridge 4 (FIG. 1), agitating the toner particles with separately stored magnetic carrier particles which constitutes two-component developer (i.e., powder) with toner particles, and supplying toner particles to the developing roller 31 having multiple magnetic poles inside. The toner particles have an average diameter of approximately 5 to 10 μm, and the magnetic carrier particles are magnetic powder, for example of ferrite, having an average diameter of approximately 30 to 100 μm. A magnetic toner containing magnetic powder may be used as developer (one-component developer).

The powder container 35 has two powder agitating/conveying members 32 and 33 provided therein that agitate toner particles supplied from the toner cartridge 4 (FIG. 1) with magnetic carrier particles, and convey the mixture to the developing roller 31. The two powder agitating/conveying members 32 and 33 are placed in parallel with the developing roller 31 with their conveying directions different from each other.

A partitioning plate 34 in parallel with the axial direction is provided between the two powder agitating/conveying members 32 and 33. As shown in FIG. 3, the partitioning plate 34 is not provided in axially end portions of the powder agitating/conveying members 32 and 33, and these end portions define respectively communication passages 341 and 342 for delivery of the developer. A developer circulative conveying route is formed in the powder container 35 by the partitioning plate 34 and the communication passages 341 and 342. The circulative conveying route assures sufficient agitation of the developer in the powder container 35 of the developing device 3. In other words, it prevents supply of insufficiently mixed developer to the developing roller 31.

The power container 35 is separated into two chambers (first and second chambers) by the partitioning plate 34. Toner particles are supplied from the toner cartridge 4 into the first chamber which is more away from the developing roller 31. A toner supplying hole is formed in a top wall of the first chamber. On the other hand, the second chamber closer to the developing roller 31 is communicating with a space in which the developing roller 31 for supplying the developer is provided. In other words, the first chamber is on an upstream side, and the second chamber is on a downstream side.

An upstream powder agitating/conveying member 32 is provided in the first chamber, while a downstream powder agitating/conveying member 33 in the second chamber. The upstream powder agitating/conveying member 32 agitates and conveys the developer containing toner particles supplied from the toner cartridge 4 in a specified conveying direction X1 in parallel with the axial direction. The developer is delivered from the first chamber via the communication passage 341 into the second chamber.

Upon receipt of the developer from the upstream powder agitating/conveying member 32, the downstream powder agitating/conveying member 33 conveys, while stirring, the developer in the conveying direction X2 opposite to the developer conveying direction X1 in the upstream powder agitating/conveying member 32. During the conveyance, a certain part of the toner particles is supplied to the developing roller 31. Then, the toner particles and the magnetic carrier particles not supplied to the developing roller 31 are delivered from the second chamber via the other communication passage 342 into the first chamber.

Figure 4:
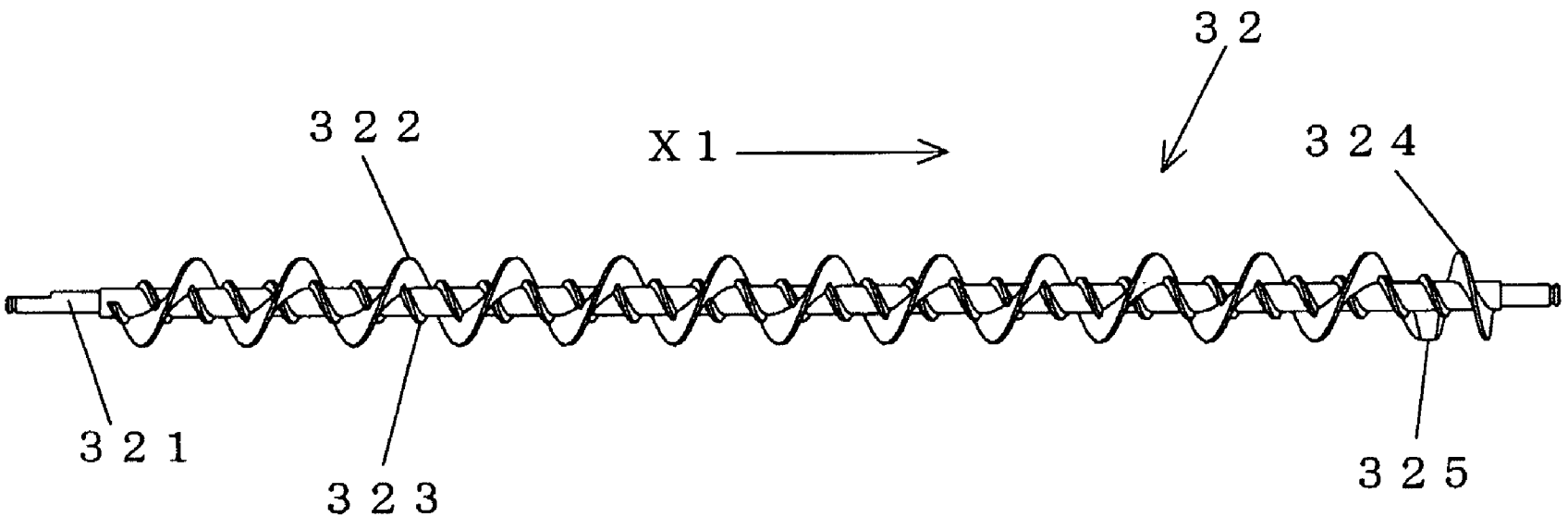
FIG. 4 is a top plan view illustrating the powder agitating/conveying member according to the embodiment of the present invention.
Figures 5A, 5B:
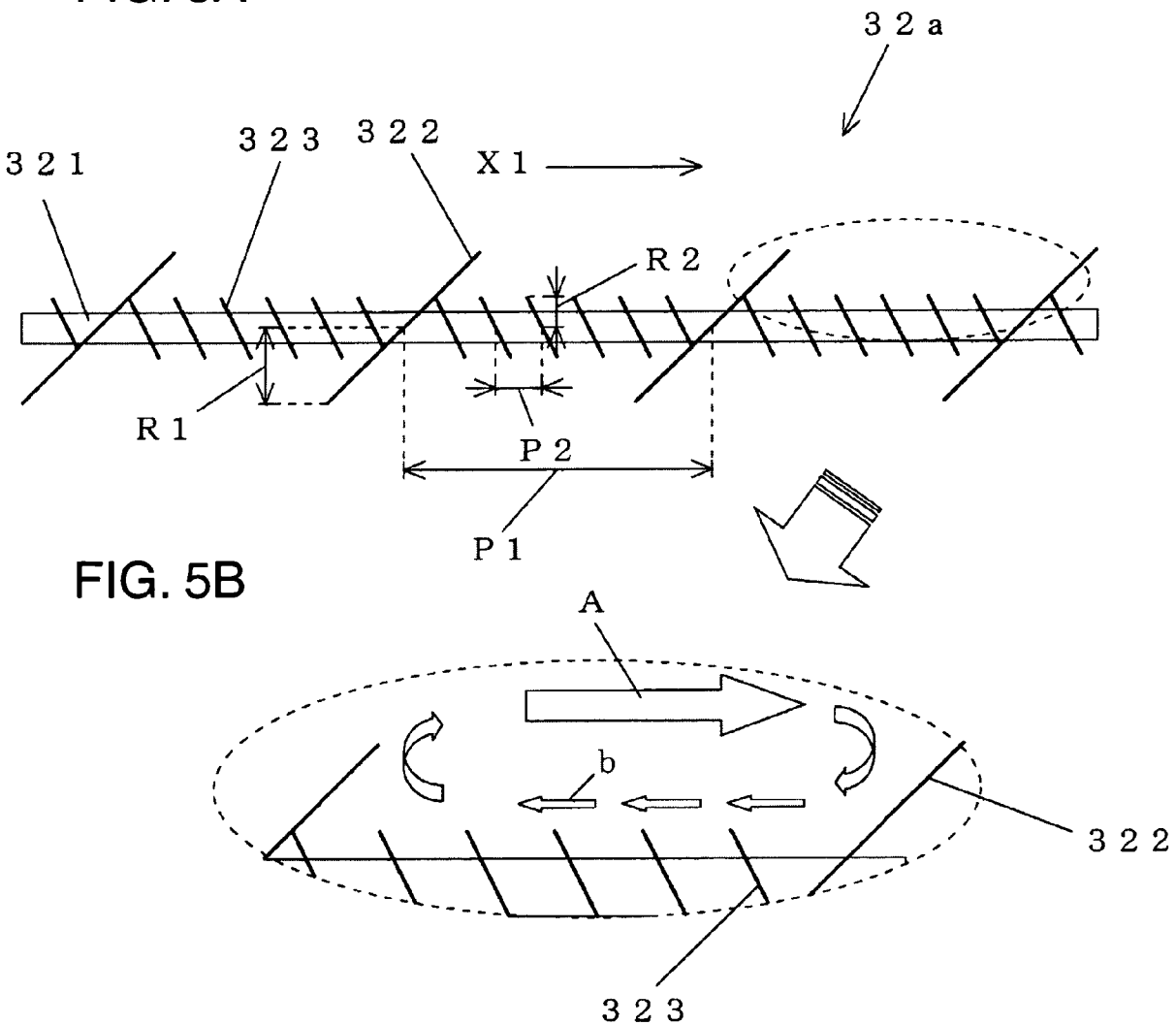
FIGS. 5A and 5B are diagrams showing a conveying force of the powder agitating/conveying member shown in FIG. 4.

The powder agitating/conveying member according to the present embodiment is used as the upstream powder agitating/conveying member 32. Hereinafter, the upstream powder agitating/conveying member 32 will be described in more detail. FIG. 4 is a plan view illustrating the powder agitating/conveying member in the first embodiment. FIGS. 5A and 5B are diagrams explaining a mechanism of the conveyance by the powder agitating/conveying member shown in FIG. 4. FIG. 5A shows an entirety, FIG. 5B shows an expanded part. In the diagrams of FIGS. 5A and 5B, the upstream powder agitating/conveying member 32 is indicated at 32*a* for convenience, but these are the same as each other conceptually.

In the present embodiment, the upstream powder agitating/conveying member 32 (32*a*) has a shaft 321 revolving around an axis thereof, a first screw blade 322 (primary conveying blade), and a second screw blade 323 (secondary conveying element).

The first screw blade 322 is formed on an external surface of the shaft 321 to convey the developer in a first direction (conveying direction X1), i.e., along one axial direction, by revolution around the axis of the shaft 321. The second screw blade 323 is formed on the external surface of the shaft to cause a convey force of conveying in a second direction a part of the developer being conveyed by the first screw blade 322 in the first direction, i.e., in the conveying direction X1. The second direction is along the opposite axial direction. A radially outer end of the second screw blade 323 is located radially inner than a radially outer end of the first screw blade 322.

More specifically, the first screw blade 322, which is formed spirally on the external surface of the shaft 321, conveys the developer while agitating it in the axial direction (conveying direction X1) by revolution of the shaft 321 around the axis thereof in the powder container 35 containing the developer. The second screw blade 323 is also formed on the shaft 321 at a pitch P1 of the first screw blade 322 in such a manner that the conveying force in the direction opposite to the developer conveying direction X1 is generated by revolution thereof around the axis. The second screw blade 323 has a pitch P2 smaller than the pitch P1 of the first screw blade 322 and a blade diameter R2 smaller than a blade diameter R1 of the first screw blade 322.

With the upstream powder agitating/conveying member 32 (32*a*) in the configuration above, the first screw blade 322 formed on the external surface of the shaft 321 conveys the developer while agitating it in the first direction (conveying direction X1). The secondary conveying element or second screw blade 323 is formed in the pitch space P1 of the first screw blade 322 (between blades) on the external surface of the shaft 321. The first screw blade 322 generates the conveying force A of conveying the developer in the conveying direction X1 by revolution of the shaft 321 around the axis to convey the developer in the conveying direction X1 in the upstream powder agitating/conveying member 32. On the other hand, the second screw blade 323 generates the conveying force b of causing a part of the developer to move in the direction (second direction) opposite to the conveying direction X1 or the axial direction generated by the first screw blade 322 by revolution of the shaft 321 around the axis.

Here in the present embodiment, the secondary conveying element also has the conveying blade (second screw blade 323). The second screw blade 323 has a pitch P2 smaller than the pitch P1 of the first screw blade 322 and a blade diameter R2 smaller than the diameter R1 of the first screw blade 322 (diameter of the circle drawn by the periphery or outer end of the blade most separated from the axis). The second screw blade 323 is located radially inner than the radially outer end of the first screw blade 322. Accordingly, the conveying force b of the second screw blade 323 in the second direction is applied only to a part of the developer present close to the shaft 321 and does not interfere with the conveying force A of the first screw blade 322.

In this way, the conveying force b generated by the second screw blade 323 in the direction opposite to the developer conveying direction X1 by the first screw blade 322 causes convection in the pitch space P1 of the first screw blade 322 (see FIG. 5B). As a result, the developer is agitated more efficiently between the blade portions of the first screw blade 322 without interference with the developer conveying force A by the first screw blade 322. Therefore, it is possible to agitate powder such as developer (including toner) sufficiently and prevent reduction of the conveying speed effectively at the same time.

The second screw blade 323 has the conveying force b in the direction opposite to that of the conveying force A of the first screw blade 322, but has the pitch P2 smaller and the blade diameter R2 shorter than that of the first screw blade 322, and thus, it is possible to prompt agitation of the powder while preventing adverse influence on the entire conveying direction.

The blade diameter R2 of the second screw blade 323 is preferably a half or less of the blade diameter R1 of the first screw blade 322. It is thus possible to prevent reduction of the conveying speed effectively while generating convection in the pitch space P1 of the first screw blade 322.

In the present embodiment, the screw blades (first screw blade 322 and second screw blade 323) of the spiral continuous blade are used as an example for description. The screw blade is not limited thereto, and may be a discontinuous blade such as screw propeller, as far as it is a blade giving a conveying force in the axial direction by revolution, i.e., as far as the position of the blade moves in the axial direction by revolution of the shaft 321.

As shown in FIG. 4, the upstream powder agitating/conveying member 32 has a third screw blade 324 and a connecting blade 325 in a downstream end portion. The third screw blade 324 has a blade diameter R1 substantially equal to that of the first screw blade 322 and gives a conveying force in the direction opposite to the conveying force A (conveying direction X1) of the first screw blade. The connecting blade 325 connects the third screw blade 324 and the first screw blade 322 to each other, and has a surface in parallel with the axial direction.

The portion of the powder container 35 that is located closer to the downstream end of the upstream powder agitating/conveying member 32 in the axial direction is likely to be pressed by the developer being conveyed. Therefore, a bearing portion downstream of the upstream powder agitating/conveying member 32 receives an undesirable load because of lowering the durability of the developing device 3 and increasing the production costs owing to the necessity of a counter measure.

For reduction of the load against the bearing member, the third screw blade 324 relaxes the load in the conveying direction X1 by generating a conveying force in the direction opposite to the conveying direction X1. The connecting blade 325 connecting the first and third screw blades 322 and 324 to each other has the surface in parallel with the extension direction of the shaft 321, and thus, the developer can be delivered through the communication passage 341 to the downstream powder agitating/conveying member 33 more effectively.

In the present embodiment, as shown in FIG. 3, the downstream powder agitating/conveying member 33 is configured to have, on the shaft 321, only a blade equivalent to the first screw blade 322 described above in the upstream powder agitating/conveying member 32.

The downstream powder agitating/conveying member 33 conveys the developer while agitating in the axial direction (conveying direction X2), sprays the agitated/conveyed developer in the direction perpendicular to the axial direction over the width in the axial direction (upward in FIG. 2 seen from the side in the axial direction), and makes toner particles containing a magnetic substance adsorbed on the developing roller 31 having a magnetic pole inside. Accordingly, the downstream powder agitating/conveying member 33 does not have a blade corresponding to the second screw blade 323 in the upstream powder agitating/conveying member 32, for prevention of reduction of the conveying speed. However, depending on the specification for the powder such as toner particles, a powder agitating/conveying member similar in configuration to the upstream powder agitating/conveying member 32 may be formed in the downstream for improvement of agitation efficiency.

By using a developing device 3 having such a powder agitating/conveying member 32, it is possible to raise the conveying speed of developer reliably and also to prevent insufficient agitation of the developer, even when printing speed is raised and also the consumption speed of the developer (toner) is increased in the image forming apparatus.

Second Embodiment

A powder agitating/conveying member according to another embodiment of the present invention will be described. The powder agitating/conveying member described below may be used, replacing the upstream powder agitating/conveying member 32 (as needed, downstream powder agitating/conveying member 33) described in the embodiment above.

Figure 6A:
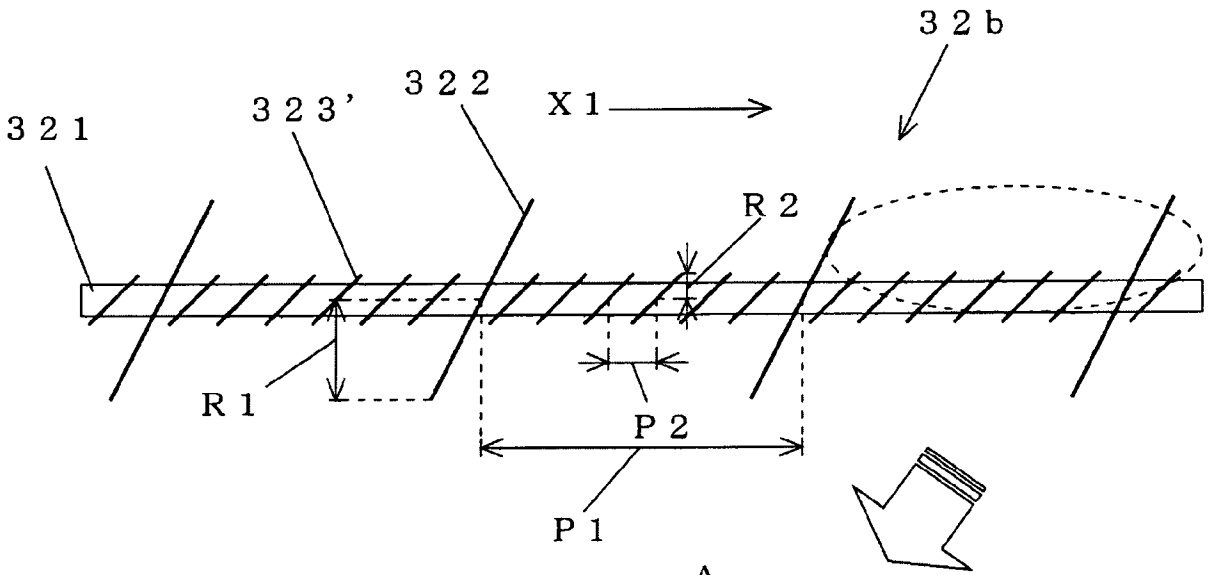
FIGS. 6A and 6B are diagrams showing the conveying force of a powder agitating/conveying member according to another embodiment of the present invention.
Figure 6B:
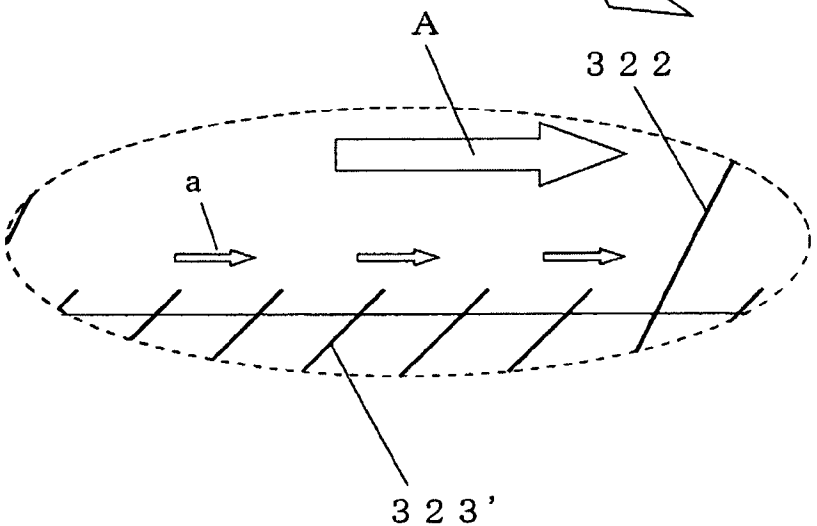

FIGS. 6A and 6B are diagrams showing conveying forces of the powder agitating/conveying member in the second embodiment. FIG. 6A shows an entirety, and FIG. 6B shows an expanded part the powder agitating/conveying member shown in FIG. 6A. In the present embodiment, a powder agitating/conveying member 32*b* is placed in a powder container 35 for storing developer containing toner particles, and has a shaft 321 revolving around an axis thereof, a first screw blade 322 (primary conveying blade), and a second screw blade 323' (secondary conveying element).

The first screw blade 322 is formed on an external surface of the shaft 321 to thereby convey the developer in a first direction along one axial direction by revolution around the axis of the shaft 321. The second screw blade 323' is formed on the external surface of the shaft 321 to thereby convey a part of the developer being conveyed by the first screw blade 322 in the first direction (conveying direction X1) at a conveying speed (conveying force a) different from the conveying speed (conveying force A) by the first screw blade 322. The radially outer end of the second screw blade 323 is located radially inner than the radially outer end of the first screw blade 322.

More specifically, the first screw blade 322 is formed spirally on the external surface of the shaft 321 and conveys the developer while agitating it in the axial direction (conveying direction X1) by revolution around the axis thereof in the powder container 35 containing the developer. The shaft 321 has the secondary conveying element, that is, the second screw blade 323', having a conveying speed different from that of the first screw blade 322, in the pitch space P1 of the first screw blade 322. The second screw blade 323' has a pitch P2 smaller than the pitch P1 of the first screw blade 322, and a blade diameter R2 smaller than a diameter R1 of the first screw blade 322.

Similarly to the first embodiment, the powder agitating/conveying member 32*b* has the first screw blade 322 formed on the external surface of the shaft 321 and conveys the developer containing toner particles while stirring it in the first direction (conveying direction X1). The second screw blade 323' is formed in the pitch space P1 of the first screw blade 322 (between blades) on the external surface of the shaft 321 to thereby cause a conveying force a in the same direction as the developer conveying direction X1 by the first screw blade 322 but having the different conveying speed.

Also in the second embodiment, the secondary conveying element has the second screw blade 323'. The second screw blade 323' generates the conveying force a in the same direction as the conveying force A generated by the first screw blade 322 (generally, the developer conveying direction X1), but has the pitch P2 smaller than the pitch P1 of the first screw blade 322 and the blade diameter R2 smaller than the blade diameter R1 (diameter of the circle drawn by the periphery of the blade most separated from the shaft) of the first screw blade 322. Accordingly, the second screw blade 323' is located radially inner than the radially outer end of the first screw blade 322 in the diameter direction. Therefore, the conveying force a in the first direction by the second screw blade 323' is applied only to a part of the developer present in the vicinity of the shaft 321 and does not interfere with the conveying force A of the first screw blade 322.

Because the second screw blade 323' has the pitch P2 smaller than the pitch P1 of the first screw blade 322, the feeding pitch of the developer per revolution becomes smaller, and the developer conveying speed in the vicinity of the second screw blade 323' is smaller than that of the developer in the vicinity of the first screw blade 322. As a result, the difference in the conveying forces (conveying speeds) is generated effectively between the first screw blade 322 and the second screw blade 323'.

The difference in the conveying force or the conveying speed of the powder such as developer containing toner particles between the first screw blade 322 and the second screw blade 323' generates convection in the pitch space P1 of the first screw blade 322, which, in turn, prompts agitation of the developer between blades of the first screw blade 322 without reducing the powder conveying force by the first screw blade 322. It is thus possible to prevent reduction of the conveying speed effectively, while agitating the developer containing toner particles thoroughly.

The blade diameter R2 of the second screw blade 323' in the second embodiment is also preferably a half or less of the blade diameter R1 of the first screw blade 322. It is thus possible to generate convection in the pitch space P1 of the first screw blade 322 and also to prevent reduction of the conveying speed.

Third Embodiment

Figure 7A:
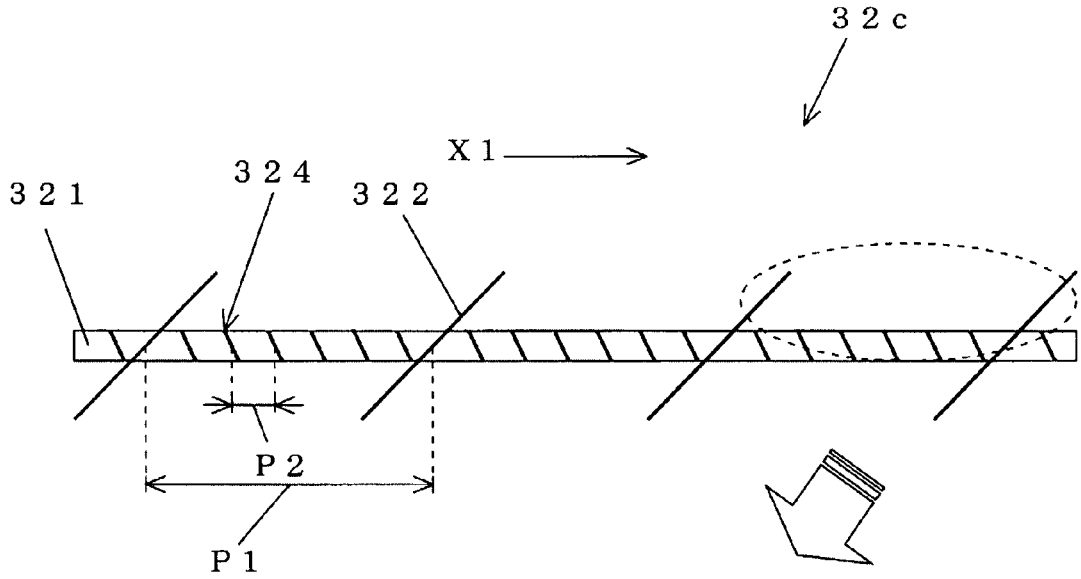
FIGS. 7A to 7C are diagrams showing the conveying force of a powder agitating/conveying member according to a third embodiment of the present invention.
Figure 7B:
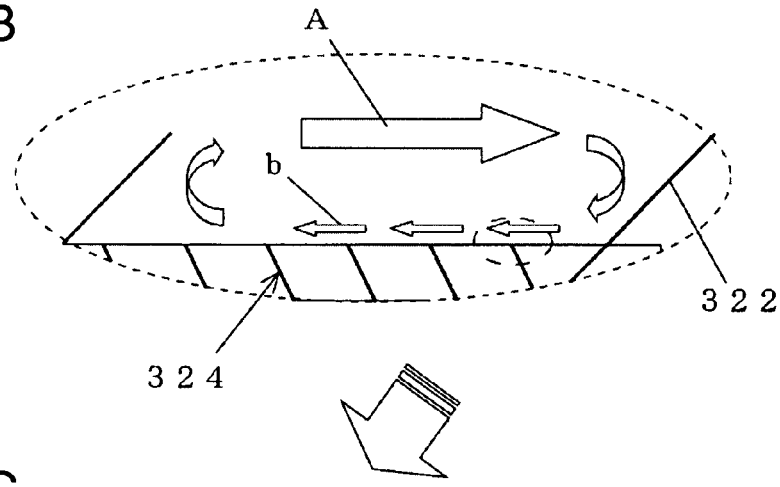
Figure 7C:
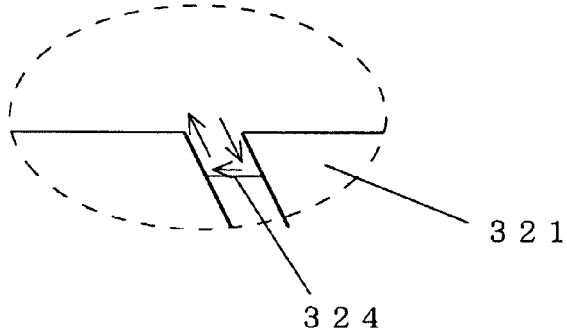

The secondary conveying element, i.e., second screw blades 323 and 323 in the foregoing two embodiments, may be replaced with a groove formed spirally in an external surface of the shaft 321. FIGS. 7A to 7C are diagrams showing conveying forces of a powder agitating/conveying member in the third embodiment of the present invention. FIG. 7A shows an entirety; FIG. 7B shows an expanded part of the power agitating/conveying member shown in FIG. 7A; and FIG. 7C shows a further expanded part of the part shown in FIG. 7B.

As shown in FIG. 7A, a groove is formed spirally in the external surface of the shaft 321 in a pitch space P1 of the first screw blade 322 of the powder agitating/conveying member 32*c* in the third embodiment. The groove 324 generates a conveying force b, similarly to the second screw blade 323 in the first embodiment.

More specifically, the first screw blade 322 applies, to the developer, a conveying force A of conveying the developer containing toner particles in a conveying direction X1 by the powder agitating/conveying member 32*c* by revolution around an axis thereof (conveying force A in the same direction as the conveying direction X1). On the other hand, the groove 324 causes a developer conveying force b, by revolution around the axis, to convey the developer in the direction opposite to the conveying direction X1 of the axial direction by the first screw blade 322.

Thus, the conveying force b generated by the groove 324 to convey the developer in the direction opposite to the conveying direction X1 by the first screw blade 322 gives rise to convection in the pitch space P1 of the first screw blade 322, as shown in FIG. 7B, which, in turn, prompts agitation of the powder between the blades of the first screw blade 322 without interfering with the powder conveying force of the first screw blade 322. It is thus possible to agitate powder such as developer containing toner particles sufficiently and also to prevent reduction of the conveying speed.

Fourth Embodiment

Figure 8A:
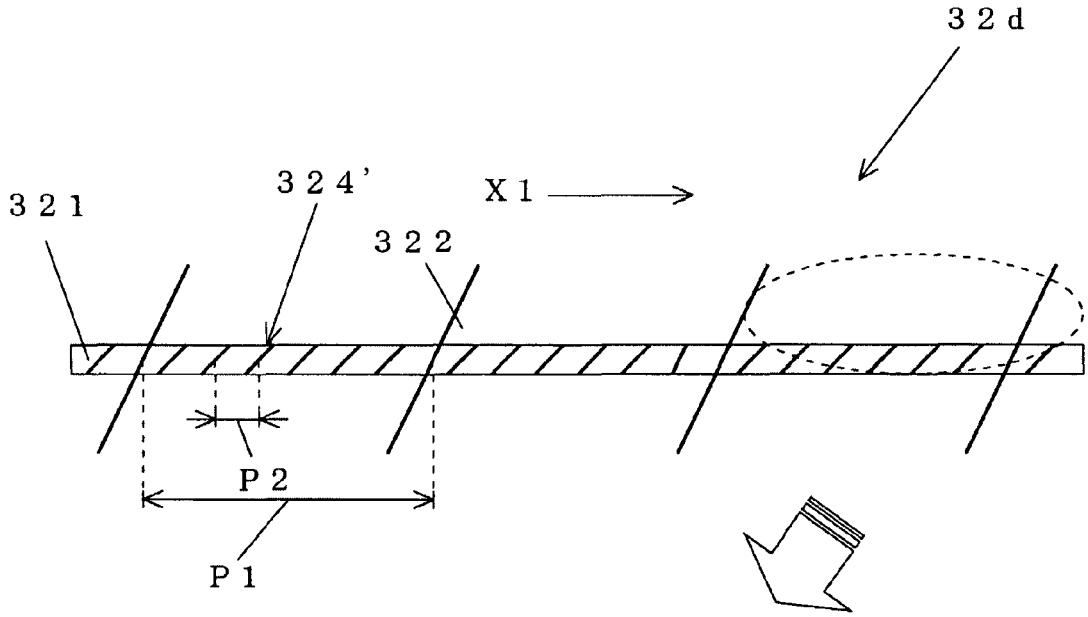
FIGS. 8A to 8C are diagrams showing the conveying force of a powder agitating/conveying member according to a fourth embodiment of the present invention.
Figure 8B:
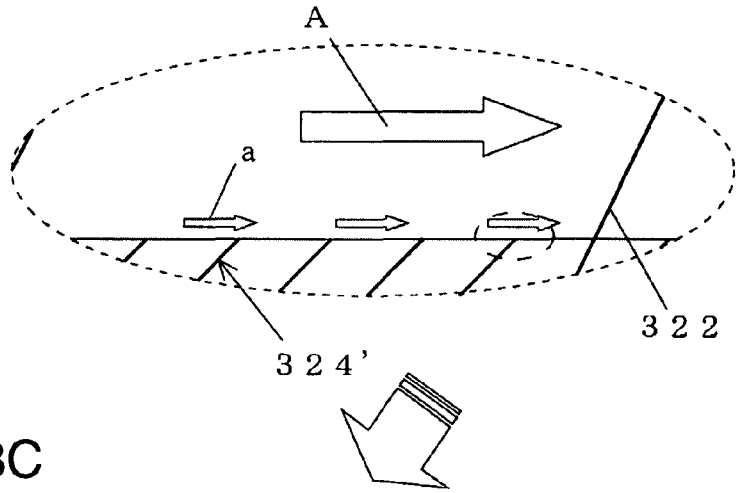
Figure 8C:
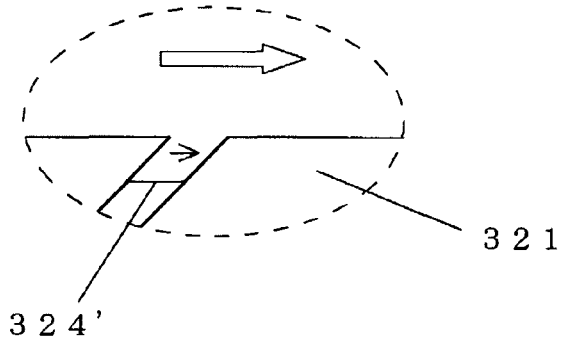

FIGS. 8A to 8C are diagrams showing conveying forces of a powder agitating/conveying member in the fourth embodiment of the present invention. FIG. 8A shows an entirety; FIG. 8B shows an expanded part of the powder agitating/conveying member shown in FIG. 8A; and FIG. 8C shows a further expanded part of the part shown in FIG. 8B.

In the powder agitating/conveying member 32*d* of the fourth embodiment, as shown in FIG. 8A, a groove 324 is formed spirally in the external surface of the shaft 321 in the pitch space P1 of the first screw blade 322. The groove 324 generates a conveying force a, similarly to the second screw blade 323' in the second embodiment.

More specifically, a groove 324' operable to generate the conveying force a in the same conveying direction X1 as the first screw blade 322 at a different conveying speed is formed in the external surface of the shaft 321 in the pitch space P1 of the first screw blade 322, in other words, between the opposite blade surfaces.

The provision of the groove 324' generating the conveying force a in the same direction as the conveying force A of the first screw blade 322 at the pitch P2 smaller than the pitch P1 of the first screw blade 322 makes the conveying speed of the developer containing toner particles in the vicinity of the groove 324' higher than that of the developer containing toner in the vicinity of the first screw blade 322. This increases the difference in the conveying force (or conveying speed) between the first screw blade 322 and the groove 324'.

Thus, the difference in the conveying force (or conveying speed) of the powder such as developer containing toner particles generated between the first screw blade 322 and the groove 324' functioning as the secondary conveying element generates convection in the pitch space P1 of the first screw blade 322, which, in turn, prompts agitation of the developer without interference with the powder conveying force of the first screw blade 322 between the opposite blade surfaces of the first screw blade 322. It is thus possible to agitate the powder such as developer containing toner particles sufficiently and also to prevent reduction of the conveying speed effectively.

In the foregoing embodiments, the spiral groove 324 or 324' are formed in the external surface of the shaft 321. The configuration of a groove formed in the shaft is not limited to the spiral form. It may be appreciated, for example, to form a groove in an external surface of the shaft 321 over an entire circumference of the shaft 321. In this case, the conveying speed in the vicinity of the shaft 321 becomes lower than that in the vicinity of the first screw blade 322 because of the groove formed in the circumference. Accordingly, it is possible to generate a difference in the conveying force (conveying speed) between by the first screw blade 322 and the groove, similarly to the foregoing embodiments, agitate the powder such as developer containing toner particles sufficiently and also prevent reduction of the conveying speed effectively.

The typical embodiments described above also include the following features.

A powder conveying apparatus is provided with a powder container for storing powder and a powder agitating/conveying member provided in the powder container. The powder agitating/conveying member includes: a shaft revolving around an axis thereof; a primary conveying blade provided on an external surface of the shaft to thereby convey powder in a first direction along an axial direction by revolution in one rotational direction around the axis of the shaft; and a secondary conveying element provided on the external surface of the shaft and located radially inner than a radially outer end of the primary conveying blade to thereby cause a conveying force to a part of the powder being conveyed in the first direction by the primary conveying blade, the conveying force being in a second direction along the opposite axial direction.

In the configuration, the primary conveying blade is formed on the external surface of the shaft, the powder is conveyed as agitated in the first direction along the one axial direction. There is also provided the secondary conveying element formed on the external surface of the shaft, and the conveying force is applied to the powder in the second direction, that is, the direction opposite to the first direction of the powder conveyed by the primary conveying blade, by revolution around the axis. The secondary conveying element is located radially inner than the radially outer end of the primary conveying blade, and the conveying force by the secondary conveying element in the second direction is applied to a part of the powder present in the vicinity of the shaft. Accordingly, it does not interfere with the conveying force by the primary conveying blade.

Therefore, the conveying force applied to the part of the powder present in the vicinity of the shaft by the secondary conveying element in the direction opposite to the powder conveying direction by the primary conveying blade generates convection of the part of the powder conveyed, which, in turn, prompts agitation of the powder in the powder container without interference with the powder conveying force by the primary conveying blade. It is thus possible to agitate the powder sufficiently and also to prevent reduction of the conveying speed effectively.

Also, a powder conveying apparatus is provided with a powder container for storing powder, and a powder agitating/conveying member provided in the powder container. The powder agitating/conveying member includes: a shaft revolving around an axis thereof; a primary conveying blade provided on an external surface of the shaft to thereby convey powder in a first direction along an axial direction by revolution in one rotational direction around the axis of the shaft; and a secondary conveying element provided on the external surface of the shaft and located radially inner than a radially outer end of the primary conveying blade to thereby cause a conveying force in the first direction to a part of the powder being conveyed in the first direction by the primary conveying blade at a conveying speed different from that of the primary conveying blade.

In the configuration, there is provided the primary conveying blade formed on the external surface of the shaft, and the powder is conveyed as stirred in the first direction along the one axial direction. There is also provided the secondary conveying element formed on the external surface of the shaft, and the conveying force is applied to the powder in the first direction by revolution around the axis, to convey it in the first direction at a conveying speed different from that of the powder conveyed by the primary conveying blade. The secondary conveying element is located radially inner than a radially outer end of the primary conveying blade, and the conveying force by the secondary conveying element in the first direction is applied to a part of the powder present in the vicinity of the shaft. Accordingly, there is a difference in the conveying speed (conveying force) between the powder conveyed by the primary conveying blade and that by the secondary conveying element, but there is no interference between the conveying forces.

Thus, the difference in the powder conveying speed (conveying force) generated between the primary conveying blade and the secondary conveying element generates convection of the part of the powder conveyed, which, in turn, facilitates agitation of the powder in the powder container without interference with the powder conveying force by the primary conveying blade. It is thus possible to agitate the powder sufficiently and also to prevent reduction of the conveying speed effectively.

Preferably, the secondary conveying element is a sub-conveying blade having a diameter smaller than that of the primary conveying blade. The diameter of the sub-conveying blade is preferably a half or less of that of the primary conveying blade.

In the configuration, the secondary conveying element also has a blade member, and the sub-conveying blade generates conveying force in the direction opposite to the powder conveying direction generated by the primary conveying blade. The sub-conveying blade has a diameter smaller than that of the primary conveying blade (diameter of the circle drawn by the periphery of the blade most separated from the shaft). Accordingly, even if the sub-conveying blade has a conveying force different from that by the primary conveying blade, it is possible to facilitate agitation of the powder, while suppressing the adverse effect on the entire conveying direction, because the blade diameter is smaller.

More preferably, the sub-conveying blade is configured to have a pitch smaller than that of the primary conveying blade. In such a case, there is provided at least one sub-conveying blade formed in the pitch space of the primary conveying blade, because the sub-conveying blade has a pitch smaller than that of the primary conveying blade. It is thus possible to facilitate agitation of the powder.

A groove formed in the external surface of the shaft may be used as the secondary conveying means, replacing the sub-conveying blade. In this configuration, the groove formed in the shaft generates difference in conveying force between in the areas close to the shaft and close to the primary conveying blade. Thus, convection of the part of the powder conveyed is generated, and the powder in the powder container is agitated without interference with the powder conveying force by the primary conveying blade. It is thus possible to agitate the powder sufficiently and prevent reduction of the conveying speed effectively.

Preferably, the groove is formed in such a manner that it has a pitch smaller than that of the primary conveying blade. In the configuration, there is formed in the pitch space of the primary conveying blade at least one spiral groove generating a conveying force different from that by the primary conveying blade. It is thus possible to prompt agitation of the powder by the groove.

Furthermore, a powder conveying apparatus is provided with a powder container for storing powder and a powder agitating/conveying member provided in the powder container. The powder agitating/conveying member includes: a shaft revolving around an axis thereof; a primary conveying blade provided on an external surface of the shaft to thereby convey powder in a first direction along an axial direction by revolution in one rotational direction around the axis of the shaft; and a groove formed in an external surface of the shaft.

A preferable modification of the powder conveying apparatus above may include a developing device having a powder container containing a developer.

This application is based on patent application No. 2006-208082 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A powder conveying apparatus, comprising:

a powder container for storing powder; and a powder agitating/conveying member provided in the powder container, the powder agitating/conveying member including:

a shaft revolving around an axis thereof;

at least one primary conveying blade provided on an external surface of the shaft with a predetermined pitch, the primary conveying blade being aligned to convey powder in a first direction along an axial direction by revolution in one rotational direction around the axis of the shaft; and a secondary conveying element provided on the external surface of the shaft in the pitch between adjacent traversals of the primary conveying blade around the shaft and being located radially inward of a radially outer end of the primary conveying blade, the secondary conveying element having a pitch smaller than the pitch of the primary conveying blade so that the secondary conveying element traverses around the shaft a plurality of times within a single pitch of the primary conveying blade, the secondary conveying element being aligned to cause a conveying force in the first direction to a part of the powder being conveyed in the first direction by the primary conveying blade at a conveying speed slower than that of the primary conveying blade.

2. The powder conveying apparatus according to claim 1, wherein the secondary conveying element is a sub-conveying blade having a diameter smaller than that of the primary conveying blade.

3. The powder conveying apparatus according to claim 2, wherein the blade diameter of the sub-conveying blade is a half or less of the blade diameter R1 of the primary conveying blade.

4. The powder conveying apparatus according to claim 1, wherein the secondary conveying element is a groove formed in the external surface of the shaft.

5. The powder conveying apparatus according to claim 4, wherein the groove extends in a spiral form and has a pitch smaller than that of the primary conveying blade.

6. The powder conveying apparatus according to claim 1, wherein the powder conveying apparatus is a developing device including a powder container for storing developer.

7. The powder conveying apparatus according to claim 1, wherein the primary conveying blade extends from a first axial position on the shaft to a second axial position on the shaft, and wherein the second conveying element extends substantially from the first axial position on the shaft to the second axial position on the shaft so that the primary conveying blade and the second conveying element cause a conveying force in the first direction from the first axial position to the second axial position on the shaft.

8. A powder conveying apparatus, comprising:

a powder container for storing powder; and a powder agitating/conveying member provided in the powder container, the powder agitating/conveying member including:

a shaft revolving around an axis thereof;

at least one primary conveying blade on an external surface of the shaft and extending from a first axial position on the shaft to a second axial position on the shaft, the primary conveying blade being aligned and configured to convey powder at a primary conveying speed in a first axial direction along the shaft by revolution in one rotational direction around the axis of the shaft, the primary conveying blade defining a primary pitch between adjacent traversals of the primary conveying blade around the shaft; and a secondary conveying element provided on the external surface of the shaft substantially from the first axial position on the shaft to the second axial position on the shaft, the secondary conveying element being located radially inward of a radially outer end of the primary conveying blade and being aligned and configured to convey the powder in the first axial direction, the secondary conveying element defining a secondary pitch between adjacent traversals of the secondary conveying element around the shaft that is smaller than the primary pitch so that the secondary conveying element traverses around the shaft a plurality of times for each traversal of the primary conveying blade around the shaft for conveying the powder at a secondary conveying speed that is slower than the primary conveying speed, whereby the primary conveying blade and the secondary conveying element convey the powder in a common axial direction along the shaft and achieve agitation of the powder due to the secondary conveying speed being slower than the primary conveying speed.

9. The powder conveying apparatus according to claim 8, wherein the secondary conveying element is a sub-conveying blade having a diameter smaller than that of the primary conveying blade, the sub-conveying blade having a radially inner part extending continuously along the external surface of the shaft.

10. The powder conveying apparatus according to claim 9, wherein the blade diameter of the sub-conveying blade is a half or less of the blade diameter R1 of the primary conveying blade.

11. The powder conveying apparatus according to claim 8, wherein the secondary conveying element is a groove formed in the external surface of the shaft.

12. A powder conveying apparatus, comprising:

a powder container for storing powder; and a powder agitating/conveying member provided in the powder container, the powder agitating/conveying member including:

a shaft revolving around and axis thereof;

a primary conveying blade spirally formed around the shaft and extending between first and second axial positions on the shaft, the primary conveying blade defining a primary outer diameter and a primary pitch between successive traversals of the primary conveying blade around the shaft, the primary conveying blade being aligned so that rotation of the shaft around the axis conveys the powder in a first axial direction along the shaft at a primary conveying speed; and a secondary conveying blade spirally formed around the shaft substantially between the first and second axial positions on the shaft, the secondary conveying blade defining a secondary outer diameter that is less than the primary outer diameter and defining a secondary pitch that is less than the primary pitch by a sufficient amount so that the secondary conveying blade traverses around the shaft a plurality of times between successive traversals on the primary conveying blade around the shaft, the secondary conveying blade being aligned to convey the powder in the first axial direction and at a secondary conveying speed that is less than the primary conveying speed, whereby the primary and secondary conveying blades simultaneously convey and agitate the powder in the powder container.

* * * * *